United States Patent [19]

Junemann

[11] 4,033,192

[45] July 5, 1977

[54] TEMPLATE FOLLOWING MECHANISM

[76] Inventor: Hubert Junemann, Sudbrackstr. 68b, 48 Bielefeld, Germany

[22] Filed: Apr. 4, 1975

[21] Appl. No.: 544,630

[30] Foreign Application Priority Data

Jan. 28, 1974 Germany ..... 2403945

[52] U.S. Cl. ..... 74/29; 74/422

[51] Int. Cl.[2] ..... F16H 19/04

[58] Field of Search ..... 74/422, 29, 89.17, 109

[56] References Cited

UNITED STATES PATENTS

| | | | |
|---|---|---|---|
| 2,502,057 | 3/1950 | Mitchell | 74/29 |
| 3,166,270 | 1/1965 | DeJong | 74/89.17 |
| 3,447,388 | 6/1969 | Darnell | 74/29 |

*Primary Examiner*—Samuel Scott

*Assistant Examiner*—Wesley S. Ratliff, Jr.

[57] ABSTRACT

A template follower mechanism for use in automatic sewing machines in which a driven pinion means is borne against a template consisting of at least two gear racks slidable against one another in two planes. The pinion means consists of a first driven pinion capable of meshing with the teeth of one of said gear racks, and a second pinion coaxial with the first pinion, capable of meshing with the other gear rack. Means for arresting and resetting the second pinion in a normal position are provided. The teeth of the second pinion are in alignment with the teeth of the first pinion. Stop means for limiting the rotary motion of the second gear rack about one tooth pitch, one half in clockwise direction and one half in counter-clock direction relating to the normal position.

1 Claim, 9 Drawing Figures

FIG. 1
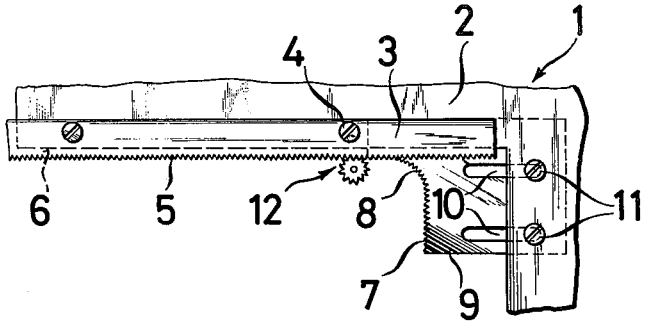
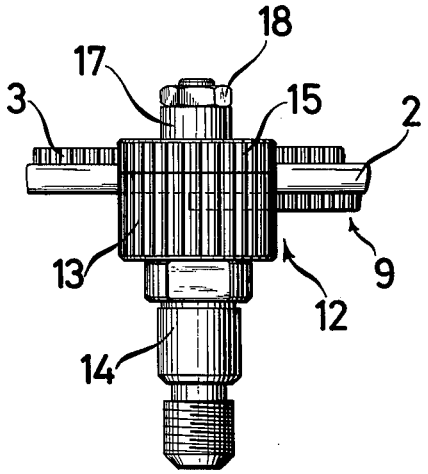
FIG. 2
FIG. 4
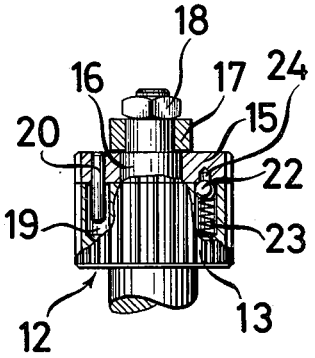
FIG. 3
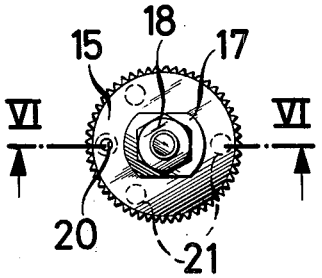
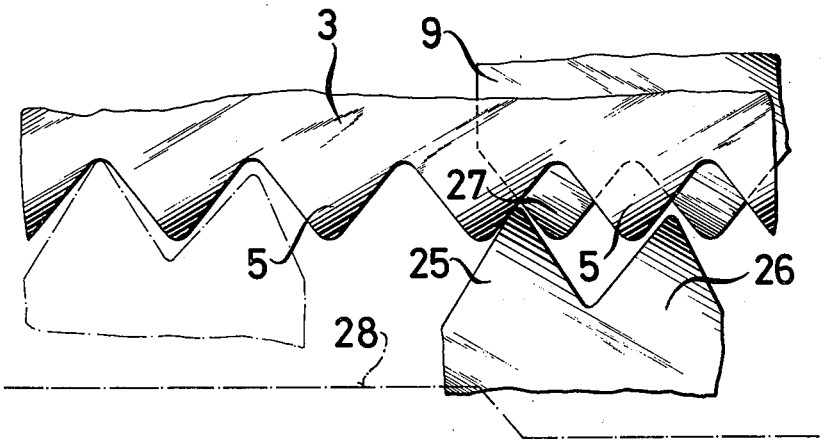
FIG. 5

FIG. 6
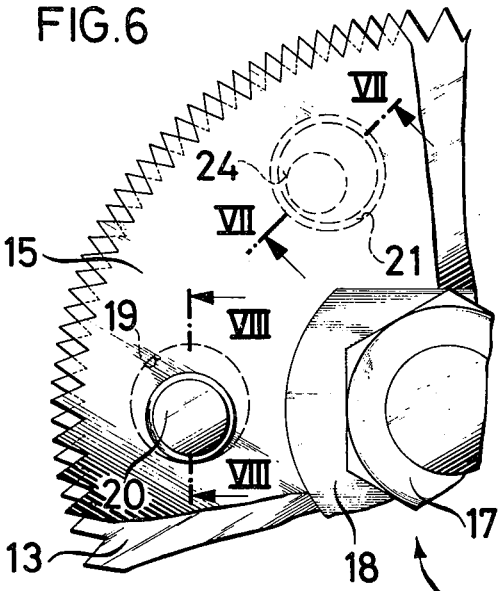
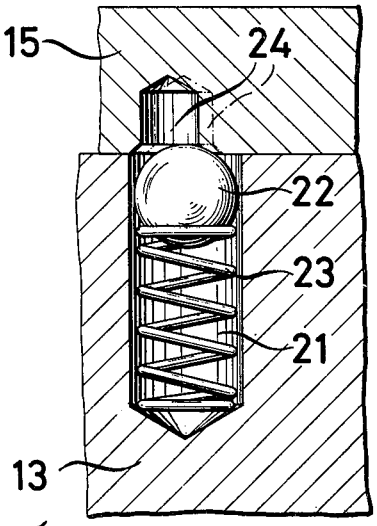
FIG. 7
12
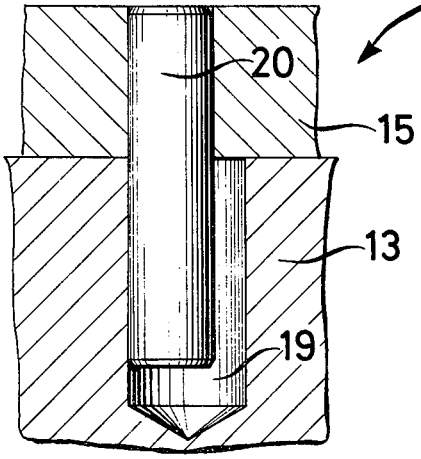
FIG. 8
FIG. 9
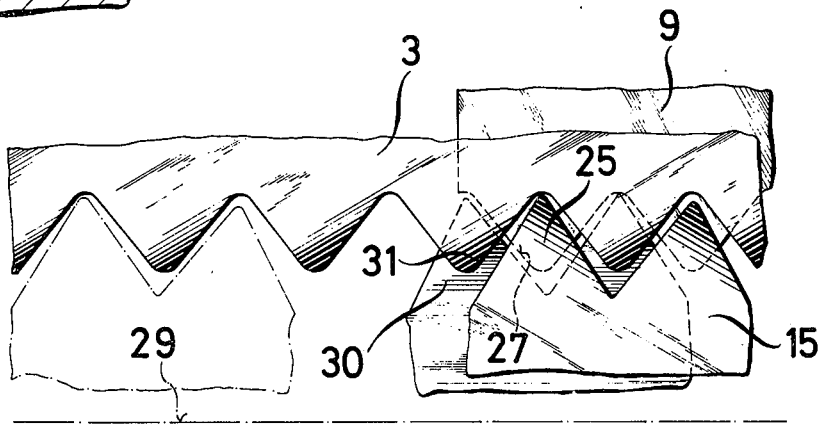

TEMPLATE FOLLOWING MECHANISM

BACKGROUND OF THE INVENTION

This invention relates to a mechanism in template controlled machine tools and particularly in automatic sewing machines, in which a driven pinion is borne against a template consisting of at least two toothed template parts which are slidable against one another in two planes.

In order to secure an uniform gearing of a standard pinion with a template consisting of two in several toothed parts which are disposed in several planes and displacable relative to one another, it is necessary to align the teeth of the template parts corresponding to the tooth pitch. For this reason it is impossible to set such a template intended for sewing workpieces of the same shape, stepless to diverse sizes.

It is the object of this invention to provide a mechanism which is adapted for use in template controlled machine tools or automatic sewing machines, in which the template consists of two or more tooth parts which are slidable against one another in two planes, in order to permit a stepless removal of the toothed template parts and an unobjectable meshing of a pinion with the teeth of the template parts even the teeth are not in alignment.

SUMMARY OF THE INVENTION

The above object is attained by a driven roller which is caused to bear against a template and comprises a first dirven pinion capable of meshing with the teeth of a first template part, a second pinion coaxial with the first pinion capable of meshing with the teeth of a second template part and pivoted on the first pinion, means for arresting and resetting the second pinion in a normal position wherein the teeth of the second pinion are in alignment with the teeth of the first pinion, and stop means for limiting the rotary motion of the second pinion about one tooth pitch, one half in clockwise direction and one half in counter-clock direction relative to the normal position. The first driven pinion is provided with a shaft journal for receiving the second pinion and fastening means for securing the second pinion against axial movements. The arresting and resetting means include bores in the second pinion continuously distributed on a pitch circle, bores in the second pinion, balls received in the bores of the first pinion and springs within the bores for biasing the balls against the lateral edges of the bores in the second pinion. The stop means of the mechanism consist of a stop pin secured to the second pinion and extending into a bore which is in the first pinion. This bore has an inside diameter which permits a rotary motion of the second pinion according to one tooth pitch.

BRIEF DESCRIPTION OF THE DRAWINGS

FIG. 1 is a partial top view of a multisectional template for a driven pinion,

FIG. 2 is a front elevational view of the pinion, on an enlarged scale,

FIG. 3 is a top view of the pinion,

FIG. 4 is a section through the pinion taken along line IV—IV of FIG. 3,

FIG. 5 is an enlarged top view of the template and a pinion, which does not comply with the invention, showing the course of seam obtained herewith, FIG. 6 is a partial top view of the pinion according to the invention, on an enlarged scale, FIG. 7 is a section taken along line VII—VII of FIG. 6, FIG. 8 is a section taken along line VIII—VIII of FIG. 6, and FIG. 9 is an enlarged partial top view of the template and the pinion according to the invention, showing the course of seam obtained herewith.

DESCRIPTION OF THE PREFERRED EMBODIMENT

FIG. 1 represents a partial top view of a template 1, which serves in conjunction with a sewing device not shown, for producing cuffs. The template 1 is carried by a supporting plate 2, to the upper surface of which is fixedly screwed a rectilinear rack member 3 by means of screws 4 in such a manner, that the teeth 5 project from the inner edge 6 of the supporting plate 2. Secured to the lower surface of the supporting plate 2, displaceably, in oblong holes 10 by means of screws 11, is a rack member 9, which is formed with a rectilinear 7 and a curved inner toothing 8. Cooperating with the rack members 3 and 9 is a magnetic roller 12 (FIGS. 2 to 4 and 6 to 8) shich arranged coaxially with the needle of a sewing machine in a not further shown manner. The magnetic roller 12 comprises a first pinion 13 secured to a driven shaft 14, and a second pinion 15 which is formed with the same toothing as the first pinion 13 and pivoted to a shaft journal 16 (FIG. 3). The second pinion is secured against axial displacement by means of a disc 17 and a nut 18.

Positioned in the first pinion 13 of the magnetic roller 12 is a bore 19 (FIGS. 4,6 and 8) into which projects a stop pin 20. The latter is inserted in the second pinion 15 and makes it possible for the pinion 15 to be rotatable by one tooth pitch with regard to the first pinon 13. In the first pinion 13 are provided three recesses 21 for receiving a ball 22 and a pressure spring 23 (FIGS. 3,4,6 and 7). The movable balls 22 which have only a small lateral clearance in the first pinion 13, are pressed by means of the springs 23 into bores 24 serving as notches. The bores 24 are formed in the second pinion 15 and have a smaller diameter than the recesses 21 located in the first pinion 13.

In the normal position, wherein the teeth of the first pinion 13 are flush with the teeth of the second pinion 15, the axes of the bores 24 extend coaxially with those of the recesses 21 (dot-lined in FIG. 7). Furthermore, the stop pin 20 and the bore 19 are co-axial.

Operation of the pinions according to the invention is as follows:

Let it be assumed, that, when displacing the rack member 9 with regard to the rack member 3 (FIG. 1) in order to change over the size, the teeth of both rack members 3 and 9 are staggered as obvious from FIGS. 5 and 9. As usual pinion of one piece construction, the teeth of which can mesh with both rack members 3 and 9, when passing over from the rack member 3 to the rack member 9 (FIG. 5) would not completely cooperate with the teeth 5 and 25 of the rack members 3 and 9, but move on a path extending through the points of intersection of the tooth flanks of the upper and lower rack members 3 and 9, thus producing a seam which corresponds with the dotted line 28 in FIG. 5.

When using the pinions 13, 15 according to the invention, a seam 29 according to the workpiece and as illustrated in FIG. 9 is obtained, when the magnetic roller 12 passes over from the upper rack member 3 to the lower rack member 9. This is due to the fact, that, when the roller 12 enters the overlapping point of both superposed rack members 3 and 9, the tooth 30 of the lower rack member 3 rests against the tooth 27 of the rack member 9, whereas the tooth 25 of the second pinion 15 slides under the tension of the sping 23 (FIG. 7) along the tooth flank 31 of the upper rack member 3 into the gap of tooth. While the second pinion 15 leaves the upper rack member 3, it is returned into its normal position by means of the springs 23, so that the toothings, of the pinions 13 and 15 will be flush again.

What I claim is:

1. A template follower mechanism including a template consisting of at least a first gear rack, a second gear rack adjustably arranged in relation to said first gear rack, means for clamping together said racks after adjusting, a driven roller caused to bear against said template and comprising a driven first pinion capable of meshing with the teeth of said first gear rack and provided with a shaft journal, a second pinion coaxial with said first pinion capable of meshing with said second gear rack and pivoted on said shaft journal, and having bores therein fastening means for securing said second pinion against axial movements, means for arresting and resetting said second pinion in a normal position wherein the teeth of said second pinion are in alignment with the teeth of said first pinion, said means including bores in said second pinion continuously distributed on a pitch circle, said first pinion having bores coaxial with said bores in said second pinion, balls received in said bores of said first pinion, and springs within said bores for biasing said balls against the lateral edges of said bores in said second pinion, and stop means for limiting the rotary motion of said second pinion about one tooth pitch, one half in clockwise direction and one half in counterclock direction relative to the normal position, said stop means including a stop pin secured to said second pinion and extending into a bore located in said first pinion, said bore having an inside diameter permitting a rotary motion of said second pinion according to one tooth pitch.

* * * * *